US009174814B2

(12) United States Patent
Kayaba

(10) Patent No.: US 9,174,814 B2
(45) Date of Patent: Nov. 3, 2015

(54) POST-PROCESSING APPARATUS AND IMAGE FORMING SYSTEM

(71) Applicant: KONICA MINOLTA, INC., Chiyoda-ku, Tokyo (JP)

(72) Inventor: Zen Kayaba, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/183,402

(22) Filed: Feb. 18, 2014

(65) Prior Publication Data

US 2014/0234056 A1 Aug. 21, 2014

(30) Foreign Application Priority Data

Feb. 19, 2013 (JP) ..... 2013-030337

(51) Int. Cl.

*B65H 5/32* (2006.01)
*B42C 5/00* (2006.01)
*B65H 5/14* (2006.01)
(Continued)

(52) U.S. Cl.

CPC *B65H 5/32* (2013.01); *B41F 13/64* (2013.01); *B42B 4/00* (2013.01); *B42C 1/12* (2013.01); *B42C 5/00* (2013.01); *B42C 13/00* (2013.01); *B65H 5/14* (2013.01); *B26D 1/04* (2013.01); *B26D 1/045* (2013.01); *B26D 7/0675* (2013.01); *B65H 2301/4224* (2013.01); *B65H 2301/436* (2013.01); *B65H 2301/4479* (2013.01);
(Continued)

(58) Field of Classification Search

CPC ..... B65H 5/32; B65H 5/14; B65H 2301/436; B65H 2301/4479; B65H 2301/44795; B65H 2301/515; B65H 2301/4224; B31F 1/0035

USPC ..... 270/32, 45, 58.07, 52.17, 52.26; 412/16, 18

See application file for complete search history.

(56) References Cited

U.S. PATENT DOCUMENTS 5,377,965 A 1/1995 Mandel et al.
6,692,208 B1 * 2/2004 Watkiss et al. ..... 412/1
(Continued)

FOREIGN PATENT DOCUMENTS

EP 2644547 A1 * 10/2013
JP 07179262 A 7/1995
(Continued)

OTHER PUBLICATIONS

Japanese Office Action dated Jan. 27, 2015, issued in counterpart Japanese Application No. 2013-030337.

*Primary Examiner* — Leslie A Nicholson, III
(74) *Attorney, Agent, or Firm* — Holtz, Holtz, Goodman & Chick PC

(57) ABSTRACT

A post-processing apparatus includes a support member that supports a center-folded booklet by being inserted into the booklet along a fold of the booklet, a pair of clamp members that are disposed so as to face outer surfaces of the booklet supported by the support member and that clamp the booklet by moving closer to each other, and a post-processing mechanism that performs a post-processing operation on the booklet clamped by the pair of clamp members. The pair of clamp members clamp the booklet while moving relative to the booklet in a direction (up-down direction in the figure) so as to move away from the fold of the booklet, the direction being perpendicular to both of a clamp direction of the booklet and a direction in which the fold of the booklet extends.

7 Claims, 7 Drawing Sheets

(51) Int. Cl.

| | |
|---|---|
| ***B42B 4/00*** | (2006.01) |
| ***B42C 1/12*** | (2006.01) |
| ***B42C 13/00*** | (2006.01) |
| ***B41F 13/64*** | (2006.01) |
| *B26D 1/04* | (2006.01) |
| *B26D 7/06* | (2006.01) |

(52) U.S. Cl.
CPC . *B65H2301/44795* (2013.01); *B65H 2301/515* (2013.01); *B65H 2801/27* (2013.01)

(56) References Cited

U.S. PATENT DOCUMENTS

| | | | | |
|---|---|---|---|---|
| 7,325,799 | B2 * | 2/2008 | Watkiss | 270/39.08 |
| 7,635,120 | B2 | 12/2009 | Awano | |
| 7,823,867 | B2 * | 11/2010 | Sato et al. | 270/58.09 |
| 8,186,663 | B2 | 5/2012 | Suzuki et al. | |
| 8,191,882 | B2 * | 6/2012 | Kikkawa et al. | 270/45 |
| 8,282,091 | B2 * | 10/2012 | Furuhashi et al. | 270/45 |
| 2007/0098525 | A1 | 5/2007 | Awano | |
| 2010/0239393 | A1 | 9/2010 | Suzuki et al. | |
| 2010/0258994 | A1 | 10/2010 | Kikkawa et al. | |

FOREIGN PATENT DOCUMENTS

| | | | |
|---|---|---|---|
| JP | 2005-040890 | A | 2/2005 |
| JP | 2007-118518 | A | 5/2007 |
| JP | 2010-195582 | A | 9/2010 |
| JP | 2010-241112 | A | 10/2010 |
| JP | 2010265115 | A | 11/2010 |
| JP | 2013018633 | A | 1/2013 |

* cited by examiner

POST-PROCESSING APPARATUS AND IMAGE FORMING SYSTEM

CROSS-REFERENCE TO RELATED APPLICATION

This application is based on Japanese Patent Application No. 2013-30337 filed on Feb. 19, 2013, the contents of which are incorporated herein by reference.

BACKGROUND

1. Technical Field

The present invention relates to a post-processing apparatus that performs various post-processing operations on a center-folded booklet, and an image forming system including the post-processing apparatus.

2. Description of Related Arts

In recent years, post-processing apparatuses for performing various post-processing operations on a printed sheet output from an image forming apparatus, such as a printer or an MFP, have been increasing used. The term "post-processing operations" refers to, for example, an operation of center-folding a sheet ("folding operation"), an operation of binding a plurality of sheets with a staple ("stapling operation"), an operation of cutting an edge of a booklet ("cutting operation"), and an operation of forming a spine of a booklet ("square folding operation"), and the like.

Referring to FIG. 8A, when performing a cutting operation on a center-folded booklet B, it is necessary to clamp the booklet B with clamps 371 and 372. In the process of transferring the booklet B to the clamps 371 and 372, the position of a fold F may become displaced from the central position in the booklet B in the thickness direction.

If a cutting operation is performed on the booklet B, which is clamped in a state in which the fold F has been displaced, a cut edge E of the booklet B becomes inclined with respect to the thickness direction, so that the appearance of the finished booklet B is not good (see FIG. 8B). Likewise, referring to FIGS. 9A and 9B, if a square folding operation is performed on the booklet B, which is clamped in a state in which the fold F has been displaced (FIG. 9A), the position of a staple S may become displaced from the central position in the thickness direction or the cut edge E may become inclined, so that, also in this case, the appearance of the finished booklet B is not good (FIG. 9B). In the present example, the square folding operation is performed by moving a roller R back and forth in directions perpendicular to the plane of FIGS. 9A and 9B.

Regarding this problem, Japanese Unexamined Publication Nos. 2007-118518, 2010-195582, and 2010-241112 describe post-processing apparatuses that clamp a booklet with clamp members after pressing an end of the booklet against contact members of various types. However, even with such post-processing apparatuses, if the booklet is too strongly pressed against the contact member, the end of the booklet may become deformed, so that it is difficult to appropriately correct displacement of a fold. Japanese Unexamined Publication No. 2005-040890 describes a post-processing apparatus that clamps a portion of a booklet near an edge with clamp members. The post-processing apparatus can perform a cutting operation with high precision, but cannot correct displacement of a fold.

The present invention has been achieved to address the problems of existing technologies described above. One of the objects of the present invention is to provide a post-processing apparatus that can correct displacement of a fold in the thickness direction of a booklet that is clamped by clamped members for various post-processing operations, and an image forming system including the post-processing apparatus.

SUMMARY

To achieve at least one of the above-mentioned objects, a post-processing apparatus reflecting one aspect of the present invention comprises a support member that supports a center-folded booklet by being inserted into the booklet along a fold of the booklet, a pair of clamp members that are disposed so as to face outer surfaces of the booklet supported by the support member and that clamp the booklet by moving closer to each other, and a post-processing mechanism that performs a post-processing operation on the booklet clamped by the pair of clamp members. The pair of clamp members clamp the booklet while moving relative to the booklet in a perpendicular direction so as to move away from the fold of the booklet, the perpendicular direction being a direction that is perpendicular to both of a clamp direction in which the pair of clamp members clamp the booklet and a direction in which the fold of the booklet supported by the support member extends.

Preferably, the pair of clamp members move relative to the booklet in the perpendicular direction by sliding along a pair of first guide surfaces that are inclined at an angle with respect to the clamp direction.

DETAILED DESCRIPTION

Hereinafter, embodiments of the present invention will be described in detail with reference to the drawings. The following description does not limit the scope of the invention and the meanings of the terms described in the claims.

Figure 1:
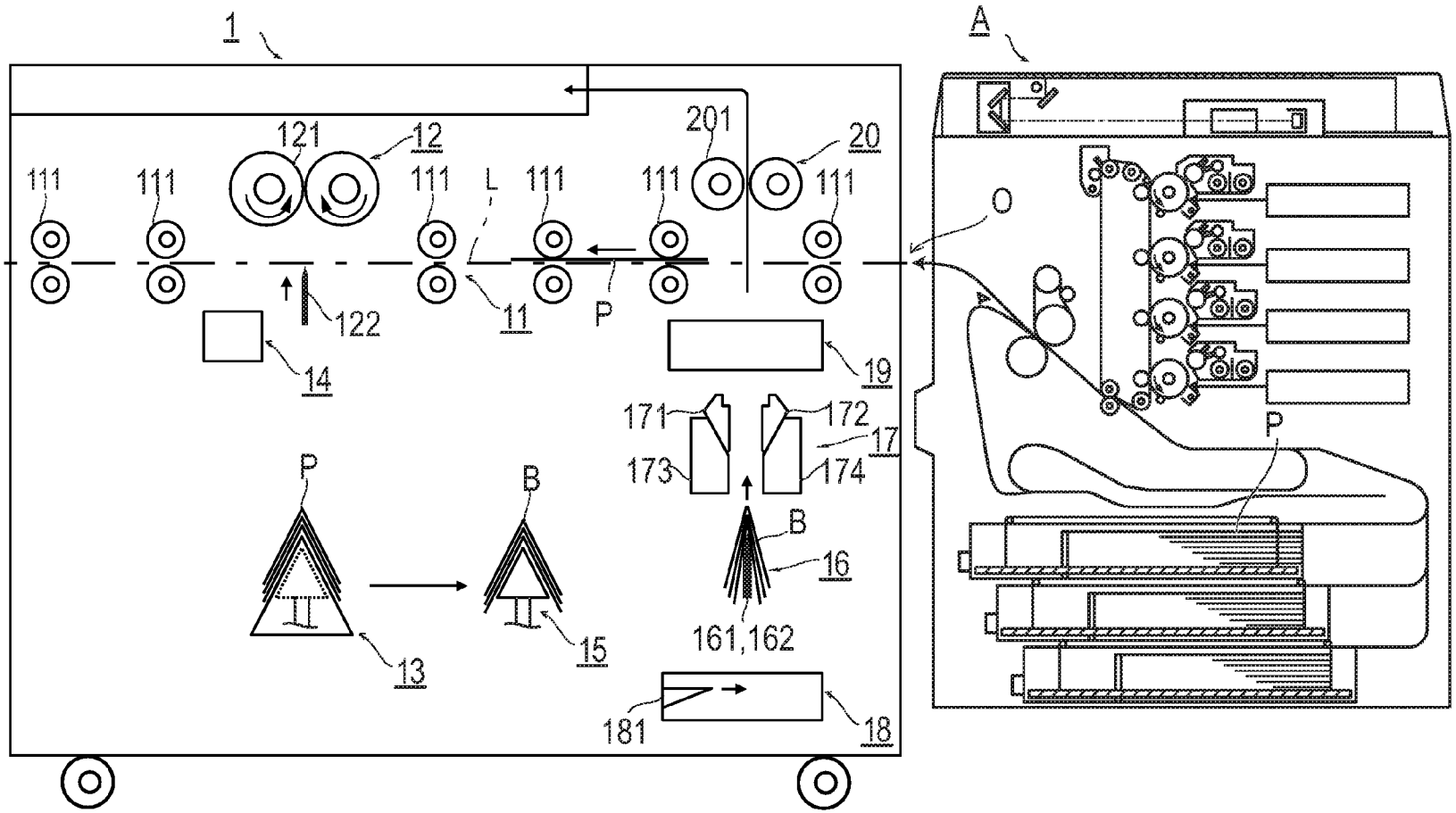
FIG. 1 is a schematic sectional view of an image forming system including a post-processing apparatus according to a first embodiment of the present invention.

FIG. 1 is a schematic sectional view illustrating the structure of a post-processing apparatus 1 according to a first embodiment of the present invention. Usually, the post-processing apparatus 1 is connected to an image forming apparatus A, which is a printer, an MFP, or the like. The post-processing apparatus 1 performs various post-processing operations on a printed sheet that has been output from the image forming apparatus A. The post-processing apparatus 1 and the image forming apparatus A constitute an image forming system that outputs a booklet on which a cutting operation, a square folding operation, and the like have been performed.

As illustrated in FIG. 1, the post-processing apparatus 1 includes a sheet transport unit 11, a folding unit 12, a stacking unit 13, a binding unit 14, a booklet transport unit 15, a support unit 16, a clamp unit 17, a cutting unit 18, a spine forming unit 19, and an output unit 20. The details of these units will be described below in this order.

The sheet transport unit 11 includes a plurality of transport rollers 111, which are arranged horizontally along a straight line, and driving means (not shown) that drives the transport rollers 111. The sheet transport unit 11 transports a printed sheet P, which has been supplied through a sheet supply port O, along a transport path L by driving the transport rollers 111. The folding unit 12 is disposed downstream of the sheet transport unit 11 along the transport path L.

The folding unit 12 is disposed above the transport path L. The folding unit 12 includes a pair of folding rollers 121 that are pressed against each other, a sheet folding knife 122 that is vertically movable, and driving means (not shown) that drives the components of the folding unit 12. The folding unit 12 performs a folding operation on the sheet P, which is transported along the transport path L, in cooperation with the sheet transport unit 11.

Figure 2:
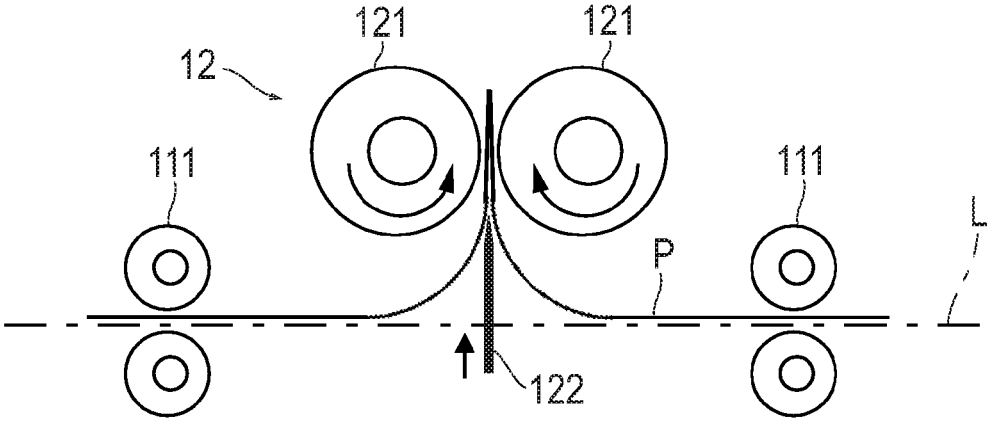
FIG. 2 is a schematic side view of a folding unit according to the first embodiment.

FIG. 2 is a schematic side view illustrating the structure of the folding unit 12. As illustrated in FIG. 2, when the sheet P reaches a position directly below the folding rollers 121, the sheet folding knife 122 is moved vertically upward to raise a central portion of the sheet P toward the folding rollers 121. At this time, the sheet P has been released from the transport rollers 111. Thus, the central portion of the sheet P is pressed into a nip between the folding rollers 121.

Next, the folding rollers 121 rotate in such directions as to pull the sheet P into the nip (in the directions of arrows in FIG. 2), thereby forming a fold in the central portion of the sheet P with a pressing force in the nip. Thus, an operation of folding (center folding) the sheet P is finished. The folding unit 12 may tri-fold the sheet P by using second folding rollers and a second sheet folding knife (not shown). When the folding operation has been finished, the folding rollers 121 rotate in reverse directions to release the sheet P. Thus, the folded sheet P is transferred to transport means (not shown), and the transport means transports the sheet P to the stacking unit 13.

The stacking unit 13 is disposed below the folding unit 12. The stacking unit 13 has an upwardly convex shape corresponding to the shape of an inner surface of the folded sheet P. For example, the stacking unit 13 has a triangular-prism shape extending in a horizontal direction. The transport means successively transports the sheets P, and the sheets P are stacked on an upper surface of the stacking unit 13 in a "saddle-straddling" manner. A set of the sheets P that are stacked in this manner will be referred to as a "booklet B". The binding unit 14 is a stapler for binding the booklet B placed on the stacking unit 13. Transport means (not shown) transports the booklet B, which is placed on the stacking unit 13, to the booklet transport unit 15.

The booklet transport unit 15 is disposed adjacent to the stacking unit 13. The booklet transport unit 15 includes a transport member 151, a slide member 152, and a slide rail 153 (see FIG. 3). For example, the booklet transport unit 15 is disposed in front of the stacking unit 13 in the direction perpendicular to the plane of FIG. 1. The booklet transport unit 15 transports the booklet B, which has been received from the stacking unit 13, to a position directly below the clamp unit 17.

Figure 3:
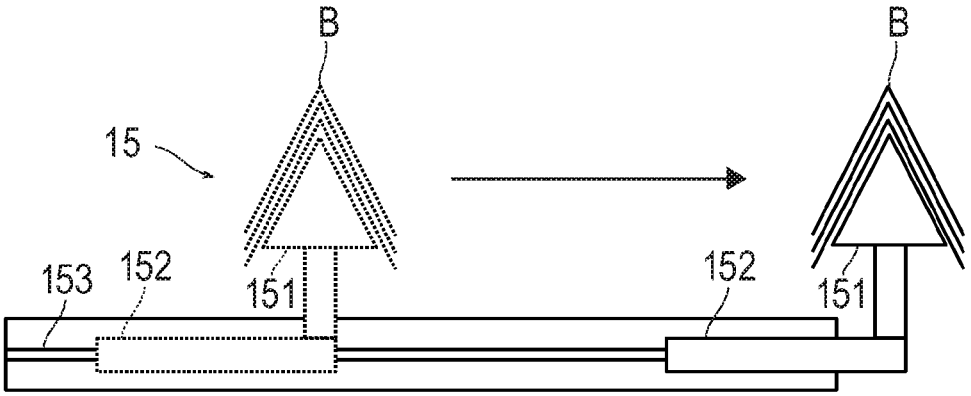
FIG. 3 is a schematic side view of a booklet transport unit according to the first embodiment.

FIG. 3 is a schematic side view illustrating the structure of the booklet transport unit 15. As illustrated in FIG. 3, as with the stacking unit 13, the transport member 151 has a shape that extends in a horizontal direction and that is upwardly convex (such as a triangular prism shape). The booklet B, which has been transported from the stacking unit 13, is placed on the transport member 151. The slide member 152 is connected to a lower portion of the transport member 151 and is engaged with the slide rail 153, which extends in a horizontal direction. The booklet transport unit 15, which has such a structure, causes driving means (not shown) to slide the slide member 152 along the slide rail 153. Thus, the booklet B, which is placed on the transport member 151, is transported in the horizontal direction and transferred to the support unit 16.

The support unit 16 includes a pair of support members 161 and 162 and driving means (not shown) that drives the components of the support unit 16. The support unit 16 suspends the booklet B placed on the transport member 151 with the pair of support members 161 and 162, and, in this state, moves the support members 161 and 162 vertically upward. Thus, the booklet B is transported vertically upward and transferred to the clamp unit 17. In the present embodiment, the term "suspend" refers to an operation of supporting an inner surface of a folded booklet by inserting a member along the fold of the booklet. The same applies to a second embodiment described below.

Figure 4A:
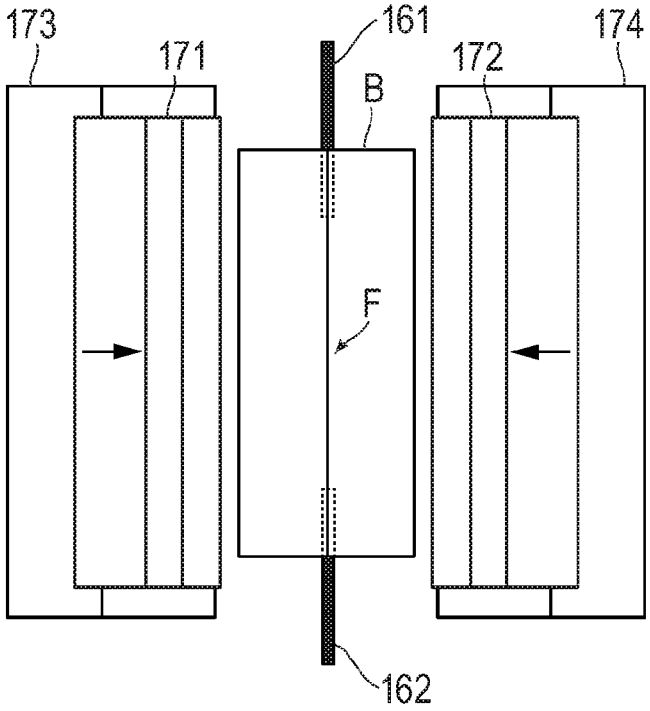
FIG. 4A is a top view of an example of a support unit and a clamp unit according to the first embodiment.
Figure 4B:
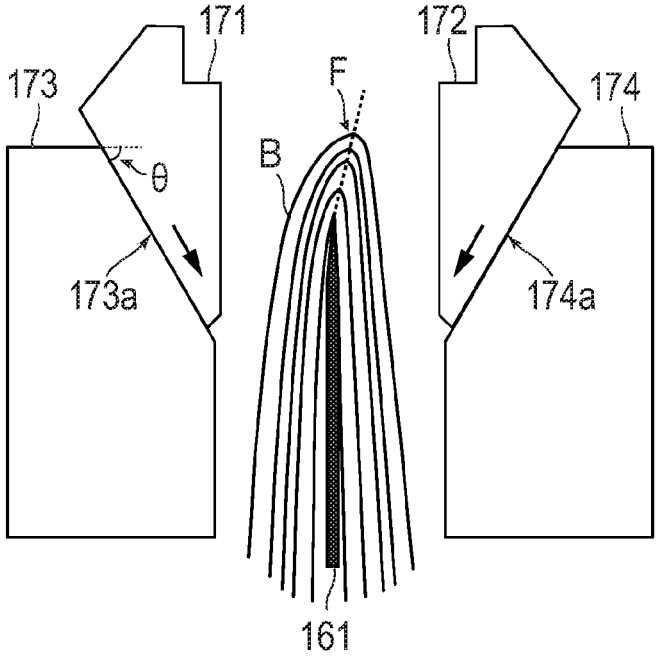
FIG. 4B is a side view of the example of the support unit and the clamp unit according to the first embodiment.

FIGS. 4A and 4B are schematic views illustrating an example of the support unit 16 and the clamp unit 17 according to the present embodiment. FIG. 4A is a top view, and FIG. 4B is a side view. As illustrated in FIG. 4A, the support members 161 and 162 are arranged in a horizontal direction and suspend the booklet B by being inserted into the booklet B from both sides of a fold F of the booklet B. As illustrated in FIGS. 4A and 4B, the support members 161 and 162 have substantially plate-like shapes corresponding to the fold F of the booklet B.

Referring back to FIG. 1, the clamp unit 17 includes a pair of clamp members 171 and 172 that are a pair of clamps or the like arranged in a horizontal direction, a pair of guide members 173 and 174 that respectively guide the clamp members 171 and 172, and a drive unit (not shown) that drives the components of the clamp unit 17. The clamp unit 17 clamps the booklet B by moving the pair of clamp members 171 and 172 closer to each other. When the booklet B has been clamped between the pair of clamp members 171 and 172, transfer of the booklet B from the support unit 16 to the clamp unit 17 is finished. A process of transferring the booklet B will be specifically described below.

(i) First, when the booklet transport unit 15 has transported the booklet B to a position directly below the clamp unit 17, the pair of support members 161 and 162 are inserted into the booklet B from both sides of the fold F. Thus, the booklet B is suspended. (ii) Next, the pair of support members 161 and 162, which are suspending the booklet B, move vertically upward. Thus, the booklet B is transported vertically upward and disposed so that an upper end portion of the booklet B is located between the pair of clamp members 171 and 172 (see FIGS. 4A and 4B). (iii) Finally, the pair of clamp members 171 and 172 move closer to each other and clamp the booklet B. When the booklet B has been transferred through the process described in (i) to (iii), the pair of support members 161 and 162 move away from each other so as to be separated from the booklet B.

Referring back to FIG. 4B, the guide members 173 and 174 according to the present example respectively have guide surfaces 173*a* and 174*a* that are inclined with respect to a clamp direction in which the clamp members 171 and 172 clamp the booklet B. The clamp members 171 and 172 clamp the booklet B by sliding along the guide surfaces 173*a* and 174*a*.

In the present embodiment, the term "clamp direction" refers to a direction in which the clamp members 171 and 172 move closer to each other when the clamp members 171 and 172 clamp the booklet B. The same applies to a second embodiment described below. In the example illustrated in FIGS. 4A and 4B, the clamp direction is the same as the horizontal direction (that is, the left-right direction in FIGS. 4A and 4B). Preferably, the inclination angle of the guide surfaces 173*a* and 174*a* with respect to the clamp direction (θ in FIG. 4B) is, for example, in the range of 45° to 80°.

Figure 5B:
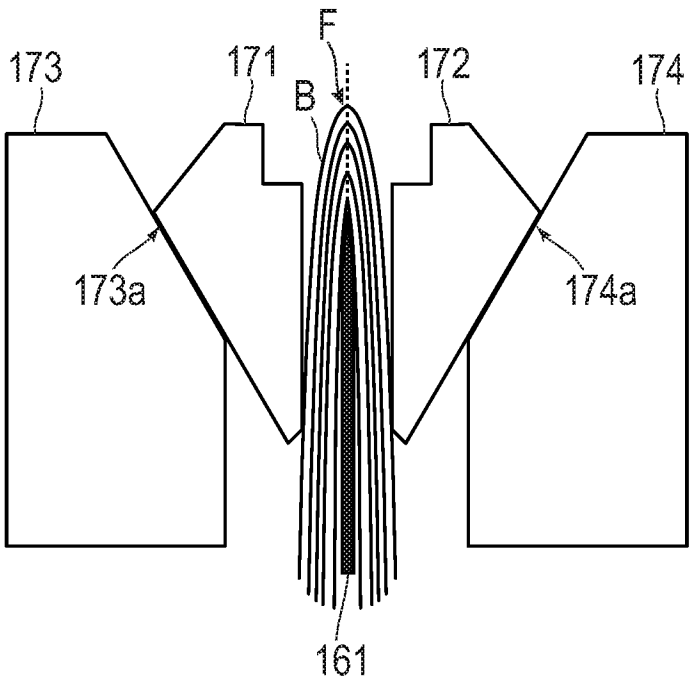
FIG. 5B is a side view illustrating the process of clamping the booklet with the clamp unit illustrated in FIGS. 4A and 4B.
Figure 5A:
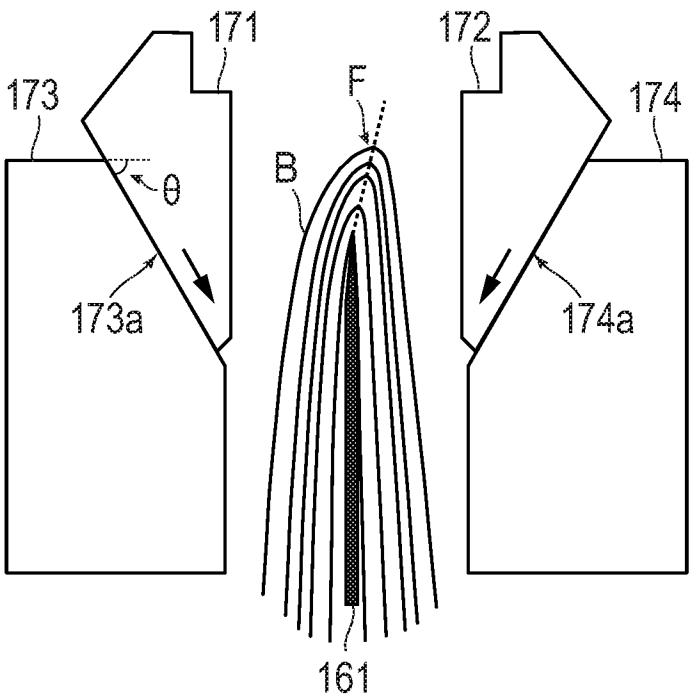
FIG. 5A is a side view illustrating a process of clamping a booklet with the clamp unit illustrated in FIGS. 4A and 4B.

FIGS. 5A and 5B are schematic side views illustrating a process of clamping the booklet B with the clamp members 171 and 172 according to the present example. FIG. 5A illustrates a state before the booklet B is clamped, and FIG. 5B illustrates a state after the booklet B has been clamped. As illustrated in FIGS. 5A and 5B, the clamp members 171 and 172 according to the present example clamp the booklet B while moving relative to the booklet B in a direction (that is, the up-down direction in FIG. 5A) that is perpendicular to both of the clamp direction (that is, the left-right direction in FIG. 5A) and a direction (that is, the direction perpendicular to the plane of FIG. 5A) in which the fold F of the booklet B, which is supported by the support members 161 and 162, extends. Hereinafter, this direction will be simply referred to as the "perpendicular direction".

To be specific, in the present example, the support members 161 and 162 are stopped when the booklet B is clamped, and therefore the booklet B is fixed in place in the perpendicular direction. Then, because the clamp members 171 and 172 respectively slide diagonally downward along the guide surfaces 173*a* and 174*a*, the clamp members 171 and 172 clamp the booklet B while moving relative to the booklet B in the perpendicular direction.

The clamp members 171 and 172 according to the present example move relative to the booklet B so as to move away from the fold F of the booklet B in the perpendicular direction. Thus, an upward pressing force is applied to portions of the booklet B at which the support members 161 and 162 contact (the inner surface of) the booklet B, and a downward frictional force is applied to a portion of the booklet B at which the clamp members 171 and 172 contact (the outer surface of) the booklet B. Because such forces in opposite directions can be applied to the inner surface and the outer surface of the booklet B supported by the support unit 16, displacement of the fold F in the thickness direction can be corrected while clamping the booklet B (see FIG. 5B).

Referring back to FIG. 1, the cutting unit 18 is disposed below the support unit 16 and the clamp unit 17. The cutting unit 18 includes a cutting blade 181 for cutting the booklet B and driving means (not shown) for driving the components of the cutting unit 18. The cutting unit 18 moves the cutting blade 181 along an edge E of the booklet B clamped by the clamp unit 17. Thus, an operation of cutting the booklet Bis finished. During this operation, the edge E of the booklet B does not become inclined with respect to the thickness direction, because displacement of the fold F of the booklet B has been corrected.

The spine forming unit 19 is disposed above the clamp unit 17. The spine forming unit 19 forms a back surface (spine) of the booklet B by moving a pressure roller (not shown) along the fold of the booklet B clamped by the clamp unit 17. Thus, an operation of square folding the booklet B is finished. During this operation, the back surface of the booklet B does not become deformed and the edge E of the booklet does not become inclined with respect to the thickness direction, because displacement of the fold F of the booklet B has been corrected. In the present example, the square folding operation is performed by moving the pressure roller back and forth in directions perpendicular to the plane of FIG. 1.

The output unit 20 is disposed above the clamp unit 17. The output unit 20 includes output rollers 201 for outputting the booklet B and driving means (not shown) for driving the components of the output unit 20. The output unit 20 outputs the post-processed booklet B to the outside of the post-processing apparatus 1 by driving the output rollers 201.

Figure 6A:
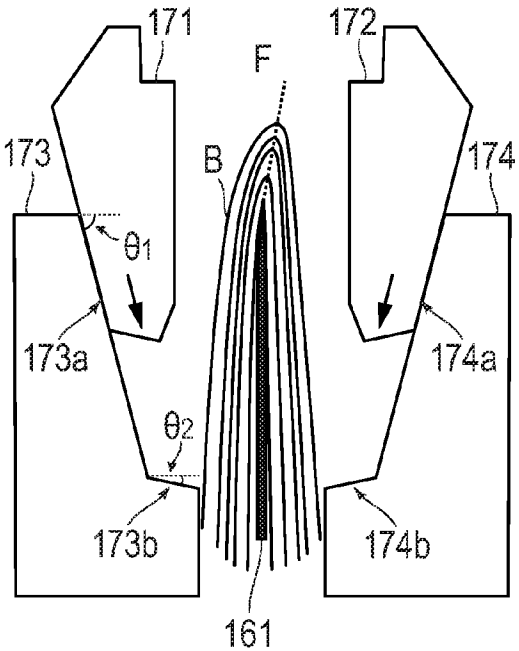
FIG. 6A is a side view of a modification of the clamp unit according to the first embodiment.
Figure 6B:
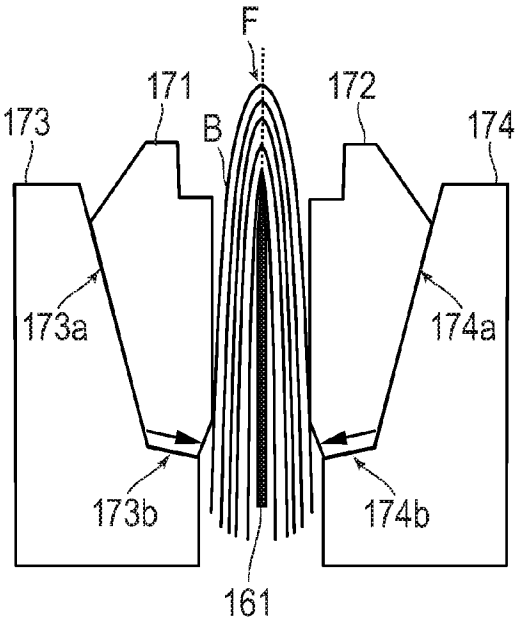
FIG. 6B is a side view of the modification of the clamp unit according to the first embodiment.
Figure 6C:
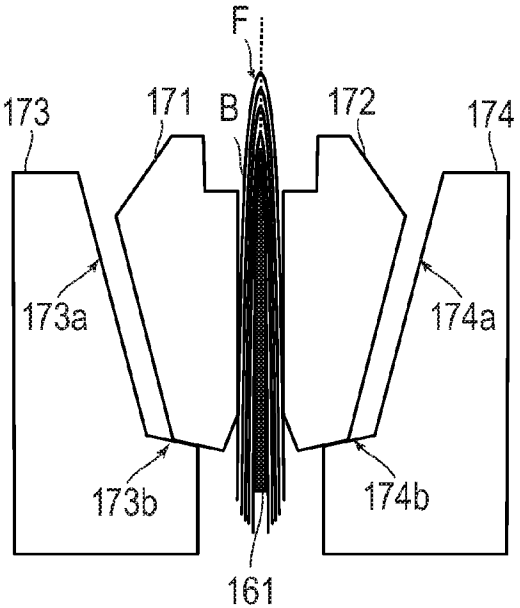
FIG. 6C is a side view of the modification of the clamp unit according to the first embodiment.

Next, a modification of the clamp unit 17 according to the present embodiment will be described. FIGS. 6A to 6C are schematic side views illustrating a process of clamping the booklet B with the clamp unit 17 according to the modification. FIG. 6A illustrates a state before the booklet B is clamped, FIG. 6C illustrates a state after the booklet B has been clamped, and FIG. 6B illustrates a state between the states illustrated FIG. 6A and FIG. 6C.

As illustrated in FIGS. 6A to 6C, the guide members 173 and 174 according to the present modification respectively have first guide surfaces 173*a* and 174*a* that are inclined at an inclination angle θ1 with respect to the clamp direction and second guide surfaces 173*b* and 174*b* that are located below the first guide surfaces 173*a* and 174*a*. The second guide surfaces 173*b* and 174*b* are inclined at an inclination angle θ2 with respect to the clamp direction, which is smaller than the inclination angle θ1 of the first guide surfaces 173*a* and 174*a* with respect to the clamp direction. For example, when the inclination angle θ1 of the first guide surfaces 173*a* and 174*a* is in the range of 45° to 80°, preferably, the inclination angle θ2 of the second guide surfaces 173*b* and 174*b* is in the range of 30° to 45°.

The clamp members 171 and 172 according to the present modification first slide along the first guide surfaces 173*a* and 174*a* (see FIGS. 6A and 6B), and subsequently slide along the second guide surfaces 173*b* and 174*b* (see FIGS. 6B and 6C). As described above, the inclination angle θ2 of the second guide surfaces 173*b* and 174*b* is smaller than the inclination angle θ1 of the first guide surfaces 173*a* and 174*a*. Therefore, the ratio of a distance over which the clamp members 171 and 172 move in the perpendicular direction to a distance over which the clamp members 171 and 172 move in the clamp direction when the clamp members 171 and 172 slide along the second guide surfaces 173*b* and 174*b* is smaller than the ratio of a distance over which the clamp members 171 and 172 move in the perpendicular direction to a distance over which the clamp members 171 and 172 move in the clamp direction when the clamp members 171 and 172 slide along the first guide surfaces 173*a* and 174*a*.

Because a repulsive force of the booklet B clamped by the clamp members 171 and 172 (that is, a force that returning the booklet B to a state before being clamped) increases as the distance between the clamp members 171 and 172 decreases, a frictional force applied to the outer surface of the booklet B increases as the distance between the clamp members 171 and 172 decreases. With the present modification, the distance over which the clamp members 171 and 172 move in the perpendicular direction is relatively small when the distance between the clamp members 171 and 172 is small, that is, when the clamp members 171 and 172 slide along the second guide surfaces 173*b* and 174*b*. Thus, it is possible to reduce scratch marks made by the clamp members 171 and 172 on the outer surface of the booklet B.

As described above, the clamp members 171 and 172 according to the present embodiment clamp the booklet B while moving relative to the booklet B in the perpendicular direction so as to move away from the fold F of the booklet B. Thus, forces in opposite directions can be applied to the inner surface and the outer surface of the booklet B, so that displacement of the fold F in the thickness direction can be corrected while clamping the booklet B for various post-processing operations (see FIGS. 5B and 6C).

Figure 7B:
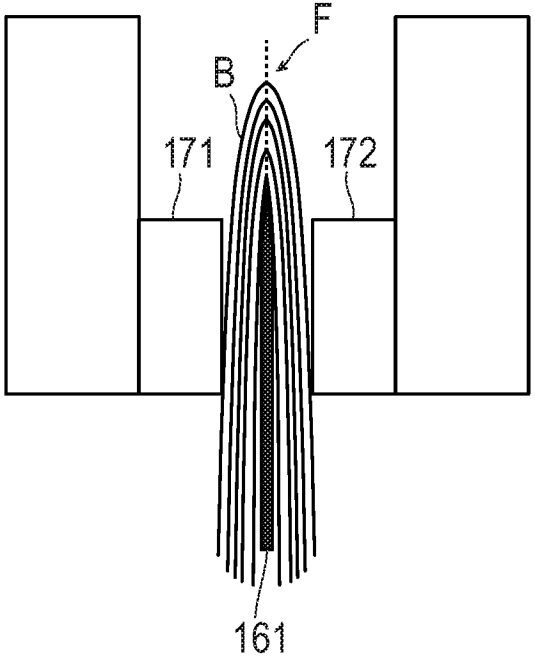
FIG. 7B is a side view of the support unit and the clamp unit according to the second embodiment.
Figure 7A:
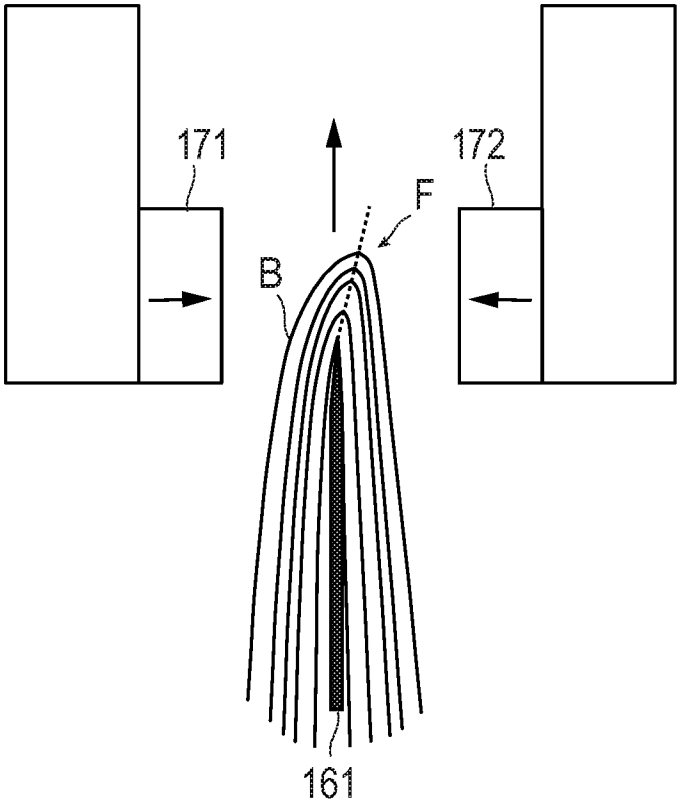
FIG. 7A is a side view of a support unit and a clamp unit according to a second embodiment.

Next, a second embodiment of the present invention will be described. FIGS. 7A and 7B are schematic views of an example of a support unit and a clamp unit according to the present embodiment. FIG. 7A illustrates a state before a booklet is clamped, and FIG. 7B illustrates a state after the booklet has been clamped. Except for the points described below, the post-processing apparatus according to the present embodiment has the same function and the same structure as those of the post-processing apparatus 1 according to the first embodiment. Therefore, the numerals the same as those of the first embodiment will be used to refer to the components of the post-processing apparatus.

As illustrated in FIG. 7A, as with the clamp members according to the first embodiment, the clamp members 171 and 172 according to the present embodiment clamp the booklet B while moving relative to the booklet B in the perpendicular direction. To be specific, in the present embodiment, the support members 161 and 162 are moved (upward) in the perpendicular direction in a state in which the clamp members 171 and 172 are fixed in place in the perpendicular direction. Thus, the booklet B move (upward) in the perpendicular direction together with the support members 161 and 162, and therefore the clamp members 171 and 172 clamp the booklet B while moving relative to the booklet B in the perpendicular direction.

As with the clamp members according to the first embodiment, the clamp members 171 and 172 according to the present embodiment move relative to the booklet B in the perpendicular direction so as to move away from the fold F of the booklet B. Thus, an upward pressing force is applied to portions of the booklet B at which the support members 161 and 162 contact (the inner surface of) the booklet B, and a downward frictional force is applied to a portion of the booklet B at which the clamp members 171 and 172 contact (the outer surface of) the booklet B. As with the clamp members according to the first embodiment, because such forces in opposite directions can be applied to the inner surface and the outer surface of the booklet B, displacement of the fold F in the thickness direction can be corrected while clamping the booklet B for various post-processing operations (see FIG. 7B).

Figure 8A:
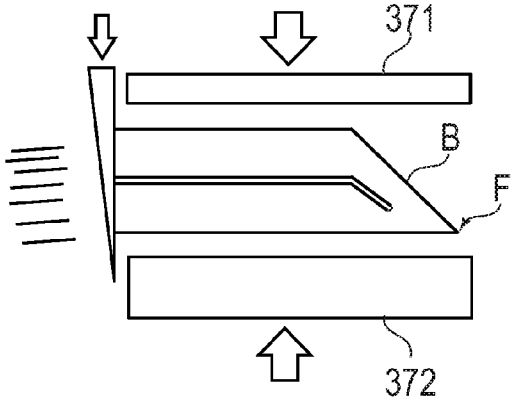
FIG. 8A RELATED ART
FIG. 8A is a schematic side view illustrating displacement of a fold that occurs when an existing post-processing apparatus is used.
Figure 8B:
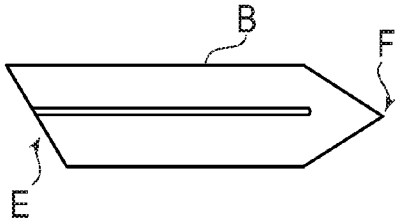
FIG. 8B RELATED ART
FIG. 8B is a schematic side view illustrating displacement of a fold that occurs when an existing post-processing apparatus is used.
Figure 9A:
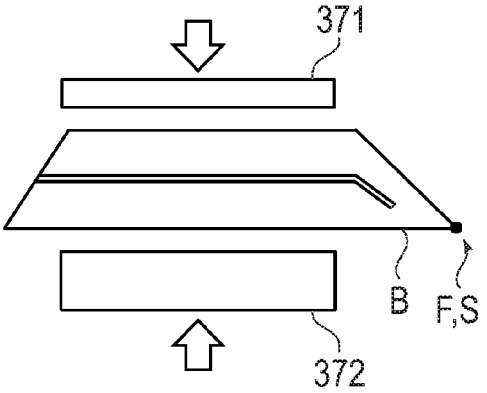
FIG. 9A RELATED ART
FIG. 9A is a schematic side view illustrating displacement of a fold that occurs when an existing post-processing apparatus is used.
Figure 9B:
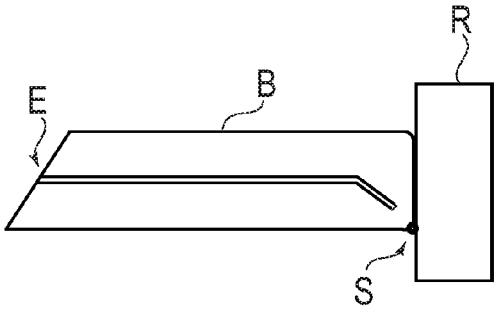
FIG. 9B RELATED ART
FIG. 9B is a schematic side view illustrating displacement of a fold that occurs when an existing post-processing apparatus is used.

The present invention is not limited to the embodiments described above and can be modified in various ways within the scope of the invention described in the claims. For example, in the embodiments described above, the pair of support members are inserted into the booklet B from both sides of the booklet B. Alternatively, a single support member may suspend a booklet by being inserted into the booklet from only one side of the booklet. In the embodiments described above, the booklet B is suspended vertically with plate-shaped support members that are disposed so as to extend perpendicular to a horizontal plane. Alternatively, the booklet B may be supported horizontally by using a substantially plate-shaped support member disposed along a horizontal plane (see, FIGS. 8A, 9A, and other figures). The dimensions, the shapes, and the materials of the components described above are only examples, and various other dimensions, shapes, and materials may be used in order to achieve the effects of the present invention.

What is claimed is:

1. A post-processing apparatus comprising:

a support member that supports a center-folded booklet by being inserted into the booklet along a fold of the booklet;

a pair of clamp members that are disposed so as to face outer surfaces of the center-folded booklet supported by the support member and that clamp the booklet by moving closer to each other; and a post-processing mechanism that performs a post-processing operation on the booklet clamped by the pair of clamp members, wherein the support member and the pair of clamp members are relatively movable in opposite directions so that the pair of clamp members move away from the fold of the booklet while sliding along the outer surfaces of the center-folded booklet, and so that the booklet clamped by the clamp members may thereafter be operated on by the post-processing mechanism.

2. The post-processing apparatus according to claim 1, wherein the pair of clamp members are movable relative to the booklet in the opposite directions by sliding along a pair of first guide surfaces that are inclined at a first angle with respect to the clamp direction.

3. The post-processing apparatus according to claim 2, wherein, after sliding along the pair of first guide surfaces, the pair of clamp members are further movable relative to the booklet in the opposite directions by sliding along a pair of second guide surfaces that are inclined at a second angle with respect to the clamp direction, the second angle being different from the first angle, and wherein a ratio of a distance over which the clamp members move in the opposite directions to a distance over which the pair of clamp members move in the clamp direction when the clamp members slide along the pair of second guide surfaces is smaller than a ratio of a distance over which the clamp members move in the opposite directions to a distance over which the pair of clamp members move in the clamp direction when the clamp members slide along the pair of first guide surfaces.

4. The post-processing apparatus according to claim 1, wherein the support member supports the booklet in a state in which the support member is fixed in place in the opposite directions.

5. The post-processing apparatus according to claim 1, wherein the support member supports the booklet while moving in the opposite directions.

6. The post-processing apparatus according to claim 1, wherein the post-processing mechanism is adapted to perform at least one of an operation of cutting an edge of the booklet and an operation of forming a spine of the booklet.

7. An image forming system comprising:

a post-processing apparatus including:

a support member that supports a center-folded booklet by being inserted into the booklet along a fold of the booklet, a pair of clamp members that are disposed so as to face outer surfaces of the center-folded booklet supported by the support member and that clamp the booklet by moving closer to each other, and a post-processing mechanism that performs a post-processing operation on the booklet clamped by the pair of clamp members, wherein the support member and the pair of clamp members are relatively movable in opposite directions so that the pair of clamp members move away from the fold of the booklet while sliding along the outer surfaces of the center-folded booklet, and so that the booklet clamped by the clamp members may thereafter be operated on by the post-processing mechanism; and an image forming apparatus that outputs printed sheets for forming the booklet and supplies the printed sheets to the post-processing apparatus.

* * * * *